United States Patent [19]

Micallef

[11] 3,948,422

[45] Apr. 6, 1976

[54] CLOSURE WITH INTEGRAL COVER FOR LATERAL SPOUT

[75] Inventor: Lewis A. Micallef, Fort Lee, N.J.

[73] Assignee: Leeds and Micallef, Fort Lee, N.J.

[22] Filed: Aug. 30, 1974

[21] Appl. No.: 502,076

[52] U.S. Cl. ..... 222/517; 222/543

[51] Int. Cl.[2] ..... B67D 3/00

[58] Field of Search ..... 222/566, 567, 569, 570, 222/529, 545, 517, 543; 215/308, 311, 307

[56] References Cited

UNITED STATES PATENTS 3,404,816 10/1968 Weber ..... 222/545

*Primary Examiner*—Stanley H. Tollberg

*Attorney, Agent, or Firm*—Kane, Dalsimer, Kane, Sullivan and Kurucz

[57] ABSTRACT

A closure for a container including a cover half with base and cover portions and a spout half with base and spout portions. A pouring orifice extends through the spout portion of the spout half. An integral hinge connects the cover half to the spout half so as to form an integral one-piece closure with the halves having been pivoted into engagement. Mating surfaces are on the bases of the cover and spout halves to facilitate cooperative interengagement therebetween and to form the closure with the cover in position for removable engagement with the spout so as to permit opening and closing of the pouring orifice as desired.

23 Claims, 15 Drawing Figures

FIG. 5
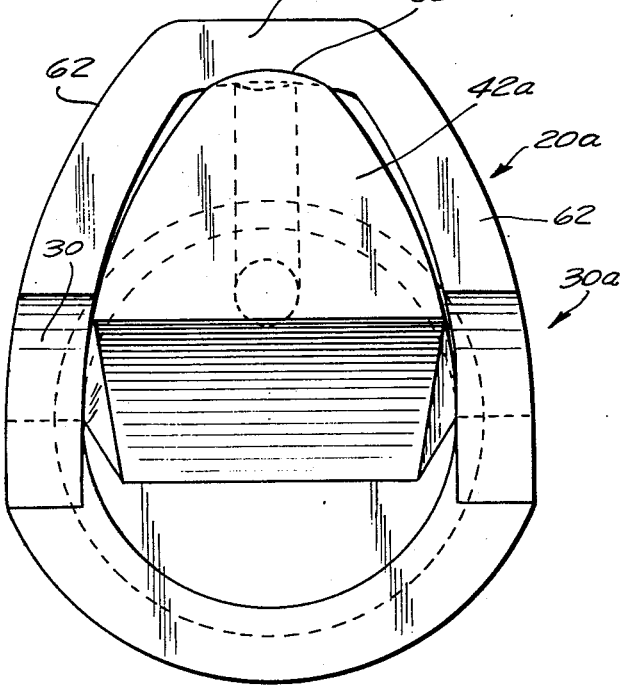
FIG. 6
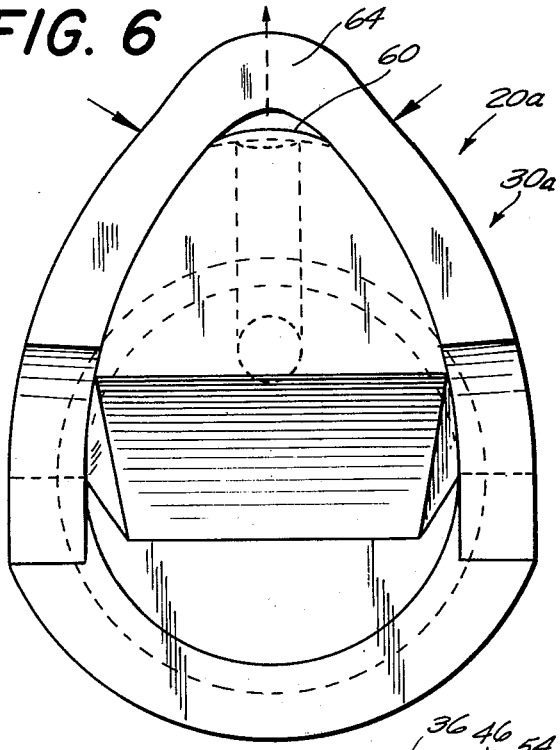
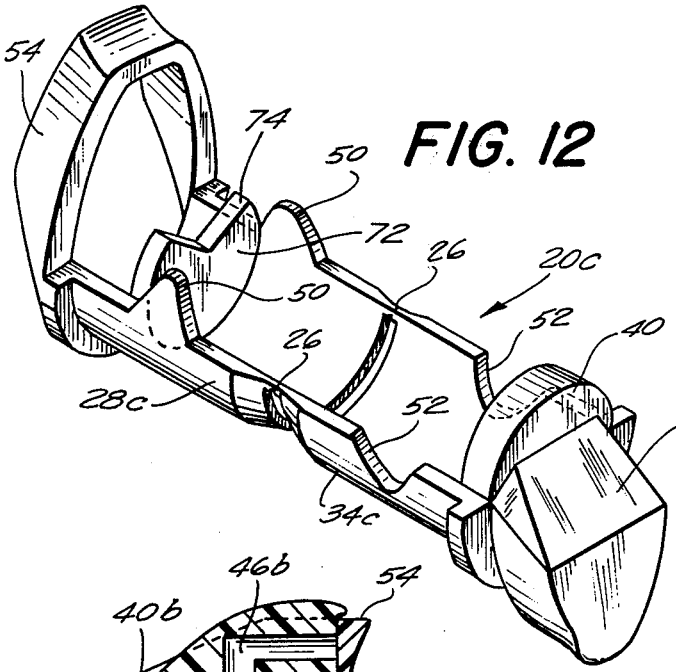
FIG. 12
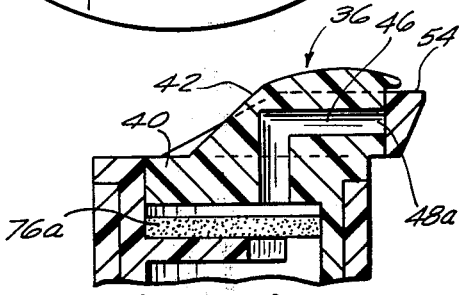
FIG. 13b
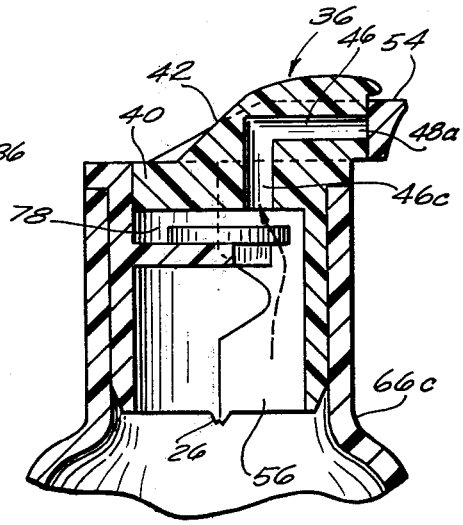
FIG. 13a
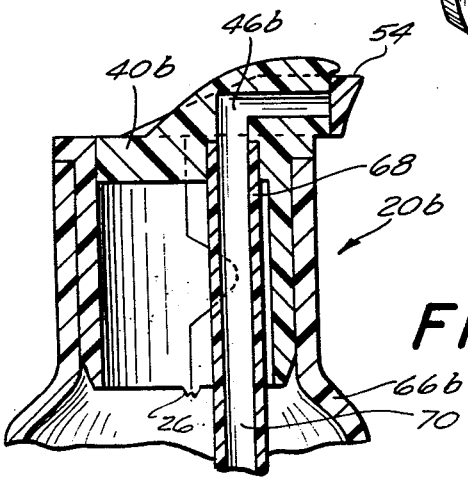
FIG. 11

CLOSURE WITH INTEGRAL COVER FOR LATERAL SPOUT

BACKGROUND OF THE INVENTION

When dealing with closures particularly for bottles and similar containers it is often desirable to have relatively inexpensive structures both from a manufacturing and a use standpoint. This is particularly true when one is concerned with disposability of the closures after use. It is of value to provide closures which can be opened and closed simply and easily to permit pouring from the container whenever desired. The closure whould be one which can be easily and quickly installed on a container and can itself be quickly and easily assembled. In fact, one-piece construction should be utilized wherever possible.

Naturally, without sacrificing simplicity of structure it is also desirable to include other features on the closure and in addition to the ability of the closure to be easily opened and closed. Safety means to assist in retaining the closure in the closed position is one additional feature which is useful. Additionally, in dealing with some materials it is helpful to have a baffle means in the closure to control flow and also to rest materials with which the fluid should come into engagement with when being dispensed. For example, this would include materials to impart a flavor to the fluid as it is passed from the container through a pouring orifice. It would be attractive to permit such closure to be adaptable to producing foam.

Another feature which is often employed as part of a closure structure is a dip tube which is to be extended into the liquid in a container to a desired depth for a desired purpose. Of course, all of the above features are utilized on occasion and they lead to a more complex and expensive closure to manufacture and utilize. Accordingly, it would be of great value to provide a closure which can accomplish all of the above structural advantages in a simple and inexpensive device. A minimum amount of component parts should be employed in order to minimize the material and manufacturing costs.

SUMMARY OF THE INVENTION

With the above background in mind, it is among the primary objectives of the present invention to provide a one-piece closure of inexpensive and simple design adapted for use on a container. The closure is designed for ease in opening and closing a pouring orifice, design to include safety means on the structure to control the opening and closing of the pouring orifice, is adapted to include thereon as part of the one-piece structure a baffle to restrict flow in a desired manner and to provide means for supporting a material to be engaged by the liquid during the pouring operation, and a structure which is adapted to accept a dip tube for use in extending into a container for any of a number of desired purposes. It is also possible to use the closure as a foam generator by providing a foraminous disc in the path of fluid before it enters the outlet orifice.

In summary, the closure for the container includes a cover half and a spout half, the spout half has a base portion for mounting the closure on a container and a cover extending therefrom. The spout half has a base portion for mounting the closure on a container and a spout with a pouring orifice therethrough extending therefrom. An integral hinge connects the cover half to the spout half so as to form an integral one-piece closure with the halves having been pivoted into engagement. Mating surfaces are on the bases of the cover and spout halves to facilitate cooperative interengagement therebetween and to form the closure with the cover in position for removable engagement with the spout so as to permit opening and closing of the pouring orifice as desired.

The cover and spout halves are formed of a single piece with an integral hinge interconnecting their ends so that the halves are adapted to be folded into engagement with one another about the hinge.

With the above objectives among others in mind, reference is had to the attached drawings:

BRIEF DESCRIPTION OF THE DRAWINGS

In the drawings:

FIG. 5 is a top plan view of an alternative embodiment of the closure with the cover in locked position covering the pouring orifice;

FIG. 6 is a top plan view of the alternate embodiment of the closure showing deformation of the cover to release it from the locked position covering the pouring orifice;

FIG. 11 is a fragmentary sectional view of a second alternative embodiment of the closure mounted in a container;

FIG. 12 is a perspective view of a third alternative embodiment of the closure in unfolded condition;

FIG. 13*a* is a fragmentary sectional view of the embodiment of FIG. 12 with the cover closing the pouring orifice; and FIG. 13*b* is a foam generator embodiment of the invention.

DESCRIPTION OF THE PREFERRED EMBODIMENT

Figure 1:
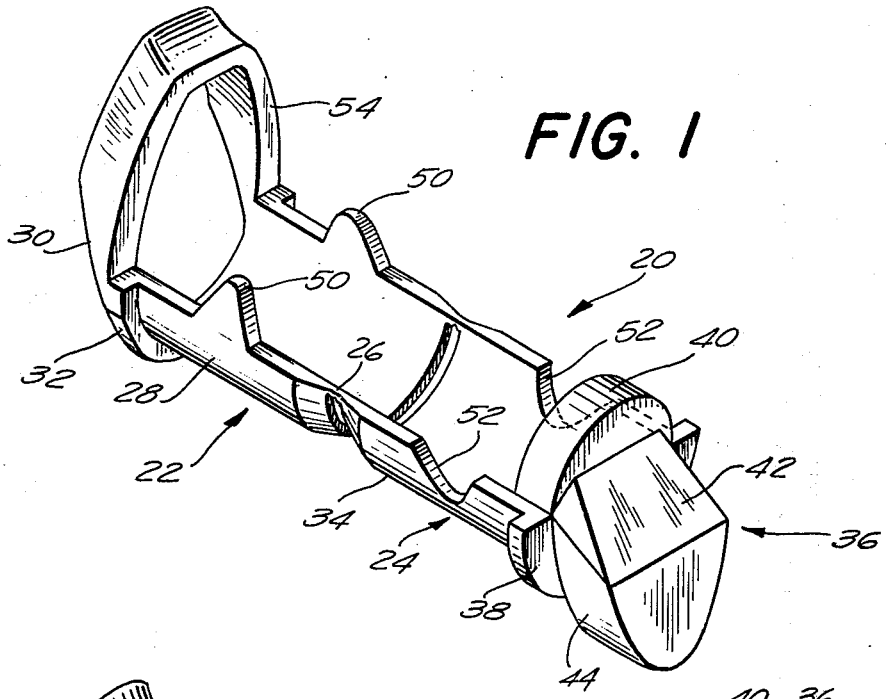
FIG. 1 is a perspective view of the closure of the invention in unfolded condition.

Closure 20 is depicted in FIGS. 1–4 and can be constructed of any well known inexpensive materials such as a platic like polypropylene. The closure is resilient while retaining desirable strength and chemical properties and is designed to be formed in a one-piece form such as by use of a conventional molding process. The closure includes a cover half 22 and a spout half 24. Halves 22 and 24 are joined end to end by means of an integral hinge 26. Hinge 26 permits the halves 22 and 24 to be folded into engagement with one another.

Half 22 includes an arcuate base portion 28 which connects to hinge 26 at one end and includes a cover 30 extending from the other end. The cover 30 is in the form of a resilient closed loop integrally connected to the end of base portion 28. A flange or rim 32 extends about the outer surface of base 28 adjacent to cover 30.

Spout half 24 also includes an arcuate base portion 34 which is connected at one end to hinge 26 and has a spout 36 extending from its other end. Once again a flange 38 extends from the periphery of base 34 adjacent to spout 36.

Figure 4B:
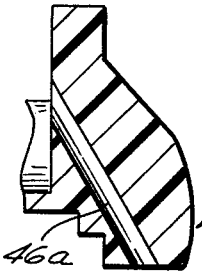
FIG. 4*b* is a similar but fragmentary side elevational view of another contemplated orifice construction for providing a different path of travel for the dispensed container contents.

The spout includes a cylindrical plug 40 integrally formed in spout half 24 and extending inwardly of the arcuate base portion 34. Extending upwardly from plug 40 is a ramp 42 which terminates in a lateral seat 44 perpendicular to the longitudinal axis of the arcuate base portion 34. A pouring orifice 46 extends axially through plug 40 to communicate with the interior of base 34 and then at right angles through ramp 42 until it forms an opening or orifice 48 on the lateral seat. Orifice 48 is perpendicular to the longitudinal axis of base 34. In FIG. 4*b* another construction orifice 48*a* is shown to facilitate dispensing the container contents at another angle relative to the longitudinal axis of the closure. Obviously other forms and dispositions fo the discharge orifices are within the purview of this invention.

A pair of opposing keys 50 extend from the exposed edges of arcuate base 28 of cover portion 22 and a pair of mating notches 52 are in the corresponding edges of base 34 on spout portion 24. The purpose of keys and notches is to keep halves in line during folding. Pressures of the cover as it moves up the ramp tends to force the spout half downward, slowing assembly.

Figure 2:
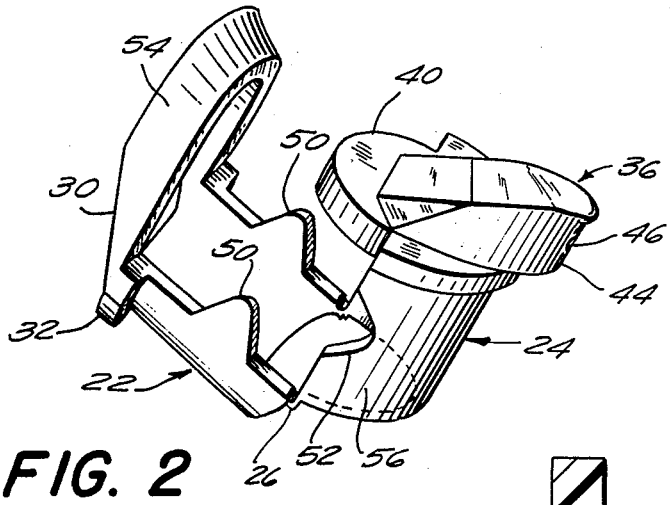
FIG. 2 is a perspective view thereof in simifolded condition.
Figure 3:
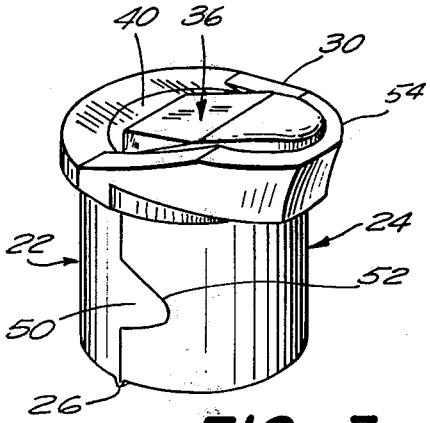
FIG. 3 is a perspective view thereof in a fully folded condition with the cover closing the pouring orifice.

Portions 22 and 24 can be folded about hinge 26 as depicted in FIG. 2 until they reach the fully closed position as depicted in FIG. 3. As shown, cover 30 extends along ramp 42 until the loop passes over the edge thereof and engages the lateral seat 44 and covers the pouring orifice 48. Cover 30 is in the full seated position when its undersurface 54 is in engagement with the upper surface of flange 38. In the folded position, when the closure 20 is fully formed, flanges 32 and 38 mate to form a continuous annular flange about the closure. Keys 50 extend into notches 52 so as to accurately mate the cover half 22 with the spout half 24. Plug 40 extends into base 28 so that it engages with the inner surface thereof and thereby continuously engages with the cylindrical wall formed by the cylinder composed of halves 22 and 24.

Figure 4A:
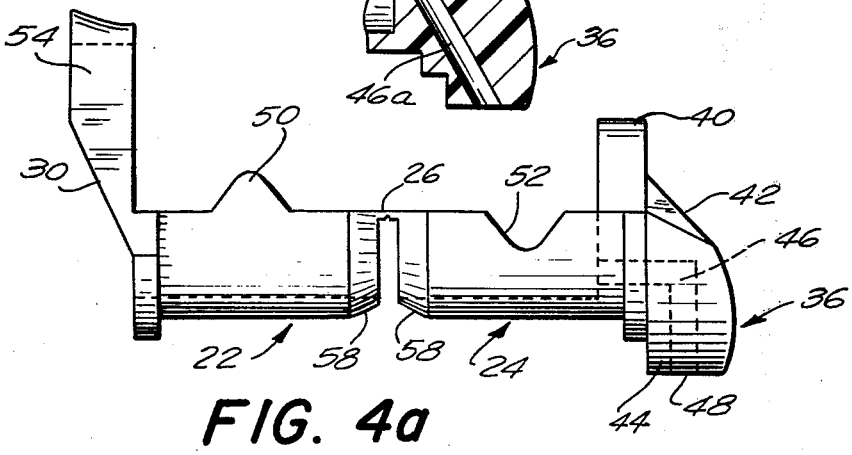
FIG. 4*a* is a side elevation view of the closure in unfolded condition.

In the fully formed position as shown in FIG. 3 the cylinder formed by halves 22 and 24 has an opening 56 at one end and is closed by spout 36 at the other end with cover 30 closing pouring orifice 48. To expose the orifice and permit fluid to pass through open end 56 of closure 20 and out through orifice 46, it is merely necessary to push resilient loop cover 30 upward and away from engagement with lateral seat 44 thereby exposing the pouring orifice and permitting flow of fluid therethrough. It should also be noted that the lower portions of bases 28 and 34 which are adjacent to hinge 26 are tapered inwardly on their exterior surface so as to form a beveled portion adjacent to opening 56 to facilitate insertion of closure 20 within the open neck of a container. These beveled surfaces 50 are opposed to one another in the unfolded position as depicted in FIG. 4 and/or combined to form a continuous annular beveled surface when the closure is folded into the operable condition.

A modification is depicted in FIGS. 5-10. Accordingly, like components are provided with like numerals as in the previous embodiment with the addition of the subscript "*a*". Closure 20*a* includes a lip 60 extending from the upper edge portion of lateral seat 44*a*. The lip 60 extending from the upper edge portion of lateral seat 44*a*. The lip is in vertical alignment with outlet orifice 48. Additionally, cover 30*a* is designed in loop form so that its pair of opposing arms 62 are normally spaced from ramp 42*a* in the closed position and the connecting portion 64 between arms 62 is in relaxed position in engagement with seat 44*a* so as to close orifice 48*a*. In the closed position as depicted in FIG. 5 with cover 30 in substantially relaxed position, the upper surface of connecting portion 64 is retained in position by engagement with lip 60. This provides a safety feature in that the cover cannot be inadvertently displaced from the spout so as to expose orifice 48.

To shift the cover from the closed to the open position it is necessary to take the action depicted by arrows in FIG. 6. Resilient arms 62 are depressed toward one another thereby deforming connecting portion 64 so that it is free from engagement with lip 60. The cover 30 can then be simply lifted upward and away from ramp 42 thereby exposing orifice 48 for the pouring operation.

Figure 7:
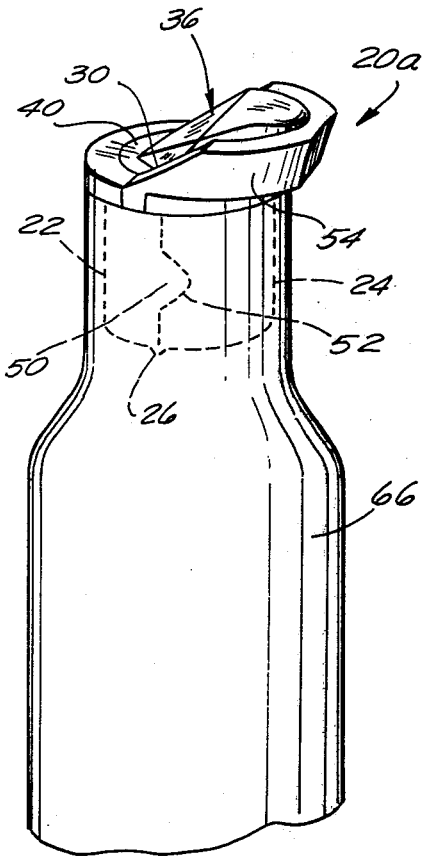
FIG. 7 is a perspective view of the alternate embodiment of the closure mounted in a bottle with the cover closing the pouring orifice.
Figure 8:
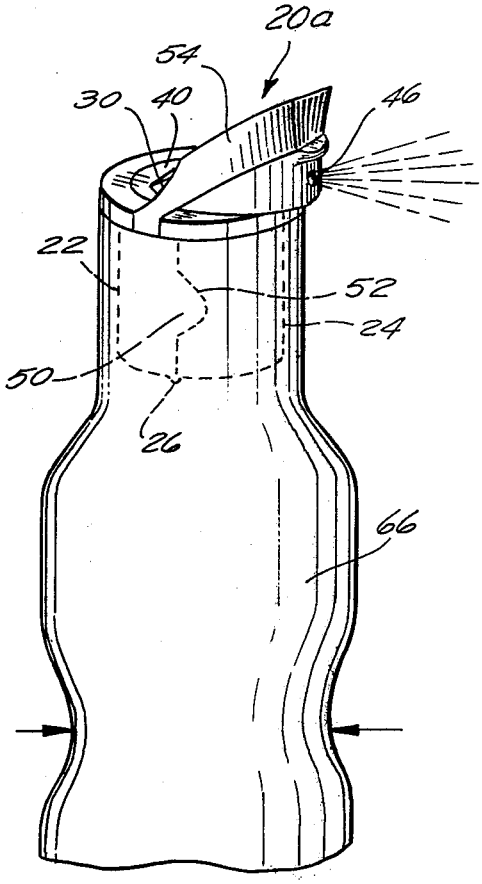
FIG. 8 is a perspective view thereof with the cover in open position with respect to the pouring orifice and pressure being applied to the bottle to expel fluid through the orifice.
Figure 9:
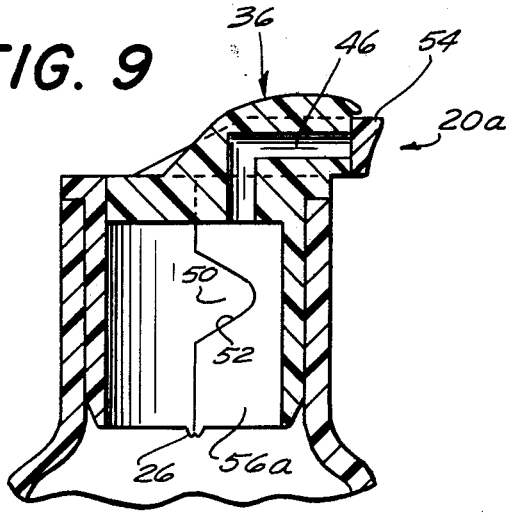
FIG. 9 is a sectional view of the closure as depicted in FIG. 7.
Figure 10:
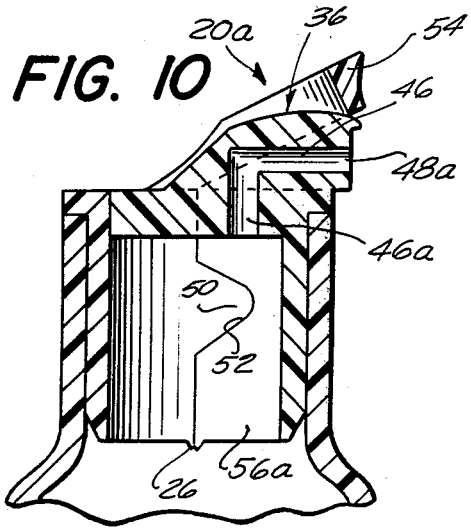
FIG. 10 is a sectional view of the closure as depicted in FIG. 8.

FIGS. 7–10 depicts closure 20*a* in operation when mounted on a conventional container 66. The type of container depicted is one which dispenses fluid by means of compression of the container to expel the fluid upward and out through closure. Closure 20*a* is inserted into the neck of container 66 by initially passing the beveled edge 58*a* of the bases 28 and 34 through the opening until the undersurface of the annular flange formed by flanged portions 32*a* and 38*a* engages with the upper rim of the container. With cover 30*a* in the closed position as depicted in FIGS. 7 and 9, orifice 46*a* is closed by cover 30*a* and accordingly no fluid can pass from the container. However, when the cover 30*a* is removed from the closed position as depicted in FIGS. 8 and 10, compression of container 66 will cause fluid to pass through opening 56*a* and through communicating orifice 46*a* and be expelled from the container through communicating outlet opening 48*a*.

A further modified form of the closure is depicted in FIG. 11 and similar components are similarly numbered as in the previous embodiments with the addition of the subscript "*b*". Closure 20*b* is modified in comparison to closure 20*a* in the respect that the portion of orifice 46*b* passing through plug 40*b* is enlarged so that it may receive the end portion of a dip tube 68 therein. The dip tube 68 can be of a conventional plastic material and can be frictionally engaged in the enlarged portion of orifice 46*b* or held in position by other conventional means such as adhesive. The dip tube 68 has a continuous passageway 70 therethrough and is open at the bottom end for insertion into fluid in an appropriate container 66*b*. The passageway communicates with pouring orifice 46*b* and accordingly fluid can pass from the container 66*b* through dip tube 70 and out through orifice 46*b* in a similar manner as described in connection with the previous embodiments.

Another modification is depicted in FIGS. 12 and 13 of the drawing. Once again similar components are similarly numbered as in the previously discussed embodiments with the addition of the subcript "*c*." Closure 20*c* is identical in all respects with respect to closure 20*b* with the exception of the addition of a integral baffle 72 formed on the interior surface of base 28*c* and extending laterally inward so as to shut off a portion of the passageway through the cylinder formed by engaged halves 22 and 24. A suitable notch 74 is provided in disc 72 so that the desired size of fluid passageway is retained for the particular use. Baffle 72 serves as a rate of flow restriction surface and additionally forms a support surface for a pellet 76 of material for use with the fluid to be dispensed. It should also be noted that the provision of baffle 74 serves to form a chamber 78 for use in bringing the fluid to be dispensed into communication with a material in pellet form or other conventional form. An example of material for pellet 36 would be a concentrate such as essence of lemon peel. Fluid passes from container 66*c* through opening 56*c* and into chamber 78 in engagement with pellet 36 and then through orifice 46*b* to be expelled from the closure and container combination through orifice 48*c*. A further embodiment can be structured similar to the embodiment of FIGS. 12 and 13*a* with the exception that the baffle 72 is replaced by a porous or foraminous disc as in FIG. 13*b* extending across the opening 56 so that a foam generator is formed. The liquid must pass through the disc before entering the orifice for expulsion from the container and closure combination as a foam.

Thus the several aforenoted objects and advantages are most effectively attained. Although several somewhat preferred embodiment have been disclosed and described in detail herein, it should be understood that this invention is in no sense limited thereby and its scope is to be determined by that of the appended claims.

What is claimed is:

1. A closure for a container comprising; a cover half having a base portion for mounting the closure on a container and a cover extending therefrom, a spout half having a base portion for mounting the closure on a container and a spout with a pouring orifice therethrough extending therefrom, an integral hinge connecting the cover half to the spout half so as to form an integral one-piece closure with the halves having been pivoted into engagement, and mating surfaces on the bases of the cover and spout halves to facilitate cooperative interengagement therebetween and to form the closure with the cover in position for removable engagement with the spout so as to permit opening and closing of the pouring orifice as desired.

2. The invention in accordance with claim 1 wherein each base is an arcuate semi-circular extension of sufficient size so as to form a tubular hollow cylinder when combined adapted for insertion into a container, the cover being a resilient loop extending laterally from the longitudinal access of the base portion, the spout including a cylindrical plug positioned to close the opening in one end of the tubular portion and having a ramp extending from the upper surface thereof and terminating in a lateral seat, the pouring orifice extending through the plug and seat so as to provide a passageway through the closure, and the loop adapted to be removably positioned about the seat so as to cover and uncover the orifice opening as desired.

3. The invention in accordance with claim 2 wherein a continuous annular rim extends around the circumference of the end of the adjoining base portions adjacent to the cover and spout so as to form a seat for the loop and its undersurface forming a stop when the closure is inserted into the opening in a container.

4. The invention in accordance with claim 1 wherein one of the cover half and the spout half having a notch on each of its exposed longitudinal edges and the other of the spout half and cover half having a key from each of its longitudinal edges with the notches and keys aligned so as to mate when the halves are brought into proper engagement.

5. The invention in accordance with claim 1 wherein the cover is resiliently deformable and the spout contains an extending lip and the cover is positioned with respect to the lip so that deformation of the cover will permit the cover to be moved with respect to the lip and when the cover is in position covering the pouring orifice and is in relaxed condition, it will be retained in that closing position by the lip.

6. The invention in accordance with claim 2 wherein the lip extends from the ramp into the path of normal movement of the resilient loop so that deformation of the loop is required to permit its passage between the open and closed position and when the loop is in position closing the pouring orifice and in the relaxed condition, the lip will engage with the loop and prevent its shifting to the open position.

7. The invention in accordance with claim 1 wherein each base is an arcuate semi-circular extension of sufficient size so as to form a tubular hollow cylinder when pivoted into engagement, the cylinder being open at the end distal from the end containing the cover and the spout, and baffle means intermediate the ends of the hollow cylinder on the interior thereof.

8. The invention in accordance with claim 7 wherein the baffle means includes notch disc integral with the inner walls of the cylinder and extending inwardly intermediate the ends of the cylinder.

9. The invention in accordance with claim 1 wherein engagement surfaces are on the closure for interengagement with a dip tube extending into and out of the closure and in fluid communication with the pouring orifice.

10. The invention in accordance with claim 2 wherein the surfaces forming the pouring orifice through the cylindrical plug form a recess for reception of the end of a dip tube to interengage therewith and provide a continuous fluid path through the pouring orifice and dip tube.

11. The invention in accordance with claim 1 wherein the closure is mounted in the neck of a container for fluid in position so that the fluid may pass out of the container through the pouring orifice when the cover is moved from the closed to the open position.

12. The deformable member adapted to be formed into a closure for insertion into a container comprising; a cover half having a base portion and a cover extending from one end thereof, a spout half having a base portion and a spout with a pouring orifice therethrough extending from one end thereof, an integral hinge interconnecting the other ends of the cover portion and the spout portion to permit folding therebetween, and mating surfaces on the cover half and the spout half so that when the cover half and spout half are folded together about the hinge their bases will mate and the cover will be in removable engagement with the spout so as to permit opening and closing of the pouring orifice as desired.

13. A one-piece closure for the neck of a container comprising:

a first closure half and a second closure half, each half having a bottom end and a top end, means hingedly connecting the bottom end of one half to the bottom end of the other half, the halves when folded about the hinge connection with each half in contact with one another defining a tubular structure, with inlet means on the base of the structure for permitting entry of the container contents and outlet means on the top end to facilitate discharge of the container contents.

14. The invention in accordance with claim 13, wherein the closure includes foam generating means for converting the container contents into a foam.

15. The invention in accordance with claim 13, wherein the closure includes means for changing the characteristics of the container contents that are discharged.

16. The invention in accordance with claim 13, wherein the closure includes baffle means for changing the flow characteristic of the container contents that are discharged.

17. The invention in accordance with claim 13, wherein the closure includes dip tube means for facilitating the dispensing of the container contents.

18. A closure for a container comprising; a substantially tubular and hollow cylinder adapted to couple with the neck of a container, a spout and cover at one end of the cylinder for extending across the opening of the neck of the container, the spout including a passageway adapted to communicate with the interior of the container and extending in a lateral direction for facilitating the dispensing of the container contents, the spout including a lateral seat and a dispensing orifice extending through the spout and seat so as to provide the passageway through the closure, the cover being integrally hinged at one end to facilitate the opening and closing of the passageway, the cover being a resilient loop extending laterally from the cylinder and adapted to be shifted from an open and closed position by the digit of one hand, the loop being adapted to be removably positioned about the seat so as to cover and uncover the orifice opening as desired.

19. The invention in accordance with claim 18, wherein a continuous annular rim extends around the circumference of the end of the cylinder adjacent to the cover and spout so as to form a seat for the loop and its undersurface forming a stop when the closure is inserted into the opening in a container.

20. The invention in accordance with claim 19, wherein the cover is resiliently deformable and the spout contains an extending lip and the cover is positioned with respect to the lip so that deformation of the cover will permit the cover to be moved with respect to the lip and when the cover is in position covering the dispensing orifice and is in relaxed condition, it will be retained in that closing position by the lip.

21. The invention in accordance with claim 18, wherein a lip extends from the spout into the path of normal movement of the resilient loop so that deformation of the loop is required to permit its passage between the open and closed position and when the loop is in position closing the dispensing orifice and in the relaxed condition, the lip will engage with the loop and prevent its shifting to the open position.

22. The invention in accordance with claim 18, wherein the closure is mounted on the neck of a container for fluid in position so that the fluid may pass out of the container through the passageway when the cover is moved from the closed to the open position.

23. The invention in accordance with claim 21, wherein the loop is adapted to rest on the lip when in an open position to permit relatively free and unobstructed dispensing of the container contents.

* * * * *